United States Patent [19]

Muzslay

[11] Patent Number: 4,840,585

[45] Date of Patent: Jun. 20, 1989

[54] BARRIER WALL CONNECTOR

[75] Inventor: Steven Z. Muzslay, Huntington Beach, Calif.

[73] Assignee: ITT Corporation, New York, N.Y.

[21] Appl. No.: 240,340

[22] Filed: Sep. 6, 1988

[51] Int. Cl.[4] ..... H01R 13/74

[52] U.S. Cl. ..... 439/556; 174/18; 174/153 R

[58] Field of Search ..... 174/18, 153 R, 153 G; 439/556, 559

[56] References Cited

U.S. PATENT DOCUMENTS

| | | | |
|---|---|---|---|
| 2,912,712 | 11/1959 | Shamban et al. | 174/153 G |
| 3,285,548 | 12/1964 | Matto et al. | 248/27 |
| 4,117,254 | 9/1978 | Richter | 174/153 R X |
| 4,295,701 | 10/1981 | Gunn | 339/94 |
| 4,445,744 | 5/1984 | Sedig et al. | 339/94 |
| 4,492,421 | 1/1985 | Ito | 339/59 |
| 4,588,247 | 5/1986 | Grappe et al. | 339/94 |
| 4,653,835 | 3/1987 | Schulte et al. | 339/128 |
| 4,713,024 | 12/1987 | Hatakeyama et al. | 339/126 |

*Primary Examiner*—Eugene F. Desmond

*Attorney, Agent, or Firm*—Thomas L. Peterson

[57] ABSTRACT

A connector is described which can be easily installed in a hole of a barrier wall, which assures tight sealing when there is a substantial pressure difference on opposite sides of the wall, and which avoids set of the sealing material. The connector includes a frame with a radially inner portion and with a skirt extending around the inner portion and slightly bendable radially outward and inward. O-rings are mounted on the outside of the skirt, so when pressure causes the skirt to expand, the O-rings form a tight fit against the surface of the hole, while when pressure is relieved the seals are pressed with less force and avoid becoming set. A group of thin limiters extend between the skirt and the inner frame portion. The limiters allow the skirt to expand radially outwardly, but limit radially inward deflection of the skirt to assure that even when there is no pressure the O-rings push firmly against the hole surface.

10 Claims, 3 Drawing Sheets

FIG. 3
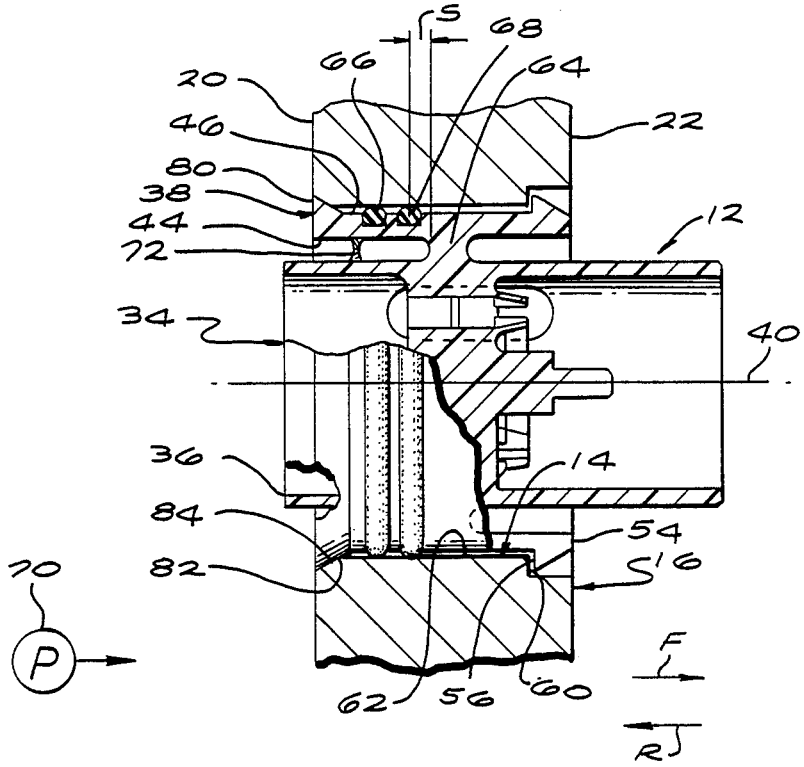
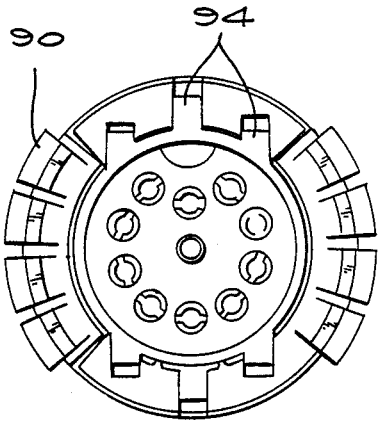
FIG. 4
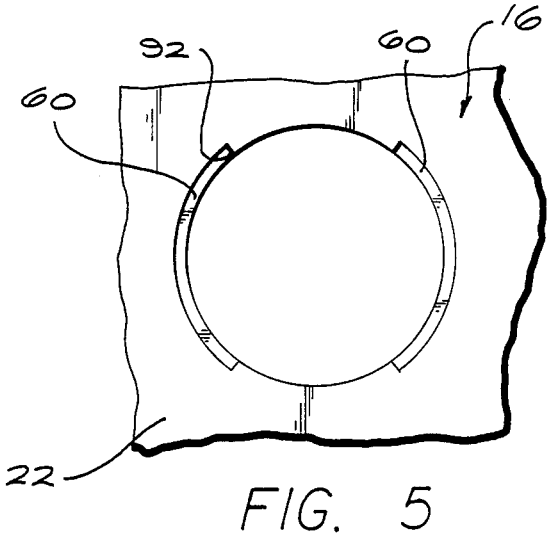
FIG. 5

BARRIER WALL CONNECTOR

BACKGROUND OF THE INVENTION

Electrical connectors are commonly used that mount in holes of barrier walls to pass electrical signals through the walls while preventing the passage of fluid across the wall. One common application is in transmitting signals through a transmission wall which separates an oil-filled transmission from the environment. The connectors may have grooves on their outside that receive O-rings to seal against the surface of the hole in the barrier wall. When there is a large pressure differential across the barrier wall, it is desirable for the O-rings to press tightly against the surface of the hole to avoid leakage. However, such tight pressing of the O-rings can be undesirable in that they can cause the O-rings to become "set" wherein continual pressure on them causes a reduction in resiliency which can later lead to leakage. Also, it can be difficult to install O-rings which press tightly against the hole surface. A connector which assured tight pressure of an O-ring or other elastomeric seal when there was a high differential pressure but which avoided set of the seal, and facilitated installation of the connector, would be of considerable value.

SUMMARY OF THE INVENTION

In accordance with one embodiment of the present invention, a connector is provided for installation in a hole in a barrier wall across which a pressure difference can exist, which is easy to install and which provides a reliable fluid-tight seal. The connector has a frame with a radially inner portion and a skirt extending around the inner portion. The frame has a connecting portion extending between the skirt and inner portion, and an O-ring or other elastomeric seal is mounted on the skirt rearward of the connecting portion. Fluid pressure applied to the rear of the skirt causes it to deflect radially outwardly to press the seal tighter against the surface of the hole, while reduction in pressure results in less pressure on the seal to avoid set of it.

A group of limiters extends between the skirt and inner frame portion at a location rearward of the connecting portion. The limiters permit the skirt to expand radially outwardly under high pressure, but limit the radially inward deflection of the skirt to assure that the seals remain pressed against the surface of the hole even when fluid pressure is reduced. The limiters can be formed as thin members that break in tension when high pressures are applied to the skirt.

The connector has forwardly-extending resilient fingers that snap into place when the connector is pushed forwardly through the hole in the barrier wall. The rear of the skirt forms a bevel which engages a correspondingly bevelled rearward edge of the hole when the fingers snap into place. The bevelled rear of the skirt provides a barrier to the rapid movement of fluid to the seals.

The novel features of the invention are set forth with particularity in the appended claims. The invention will be best understood from the following description when read in conjunction with the accompanying drawings.

BRIEF DESCRIPTION OF THE DRAWINGS

FIG. 3 is a primarily sectional view of the connector of FIG. 2 shown installed on the barrier wall, but with the connector rotated approximately 90° about its axis from the orientation of FIG. 2.

FIG. 4 is a view taken on the line 4—4 of FIG. 2.

FIG. 5 is a front view of the barrier wall of FIG. 1 at the hole therein.

DESCRIPTION OF THE PREFERRED EMBODIMENT

Figure 1:
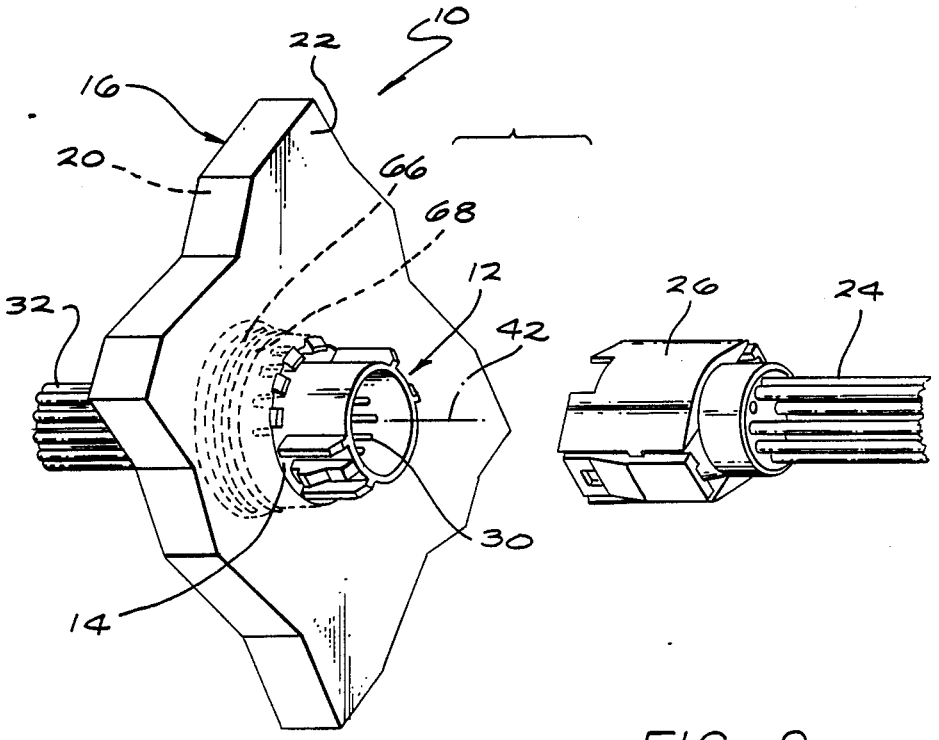
FIG. 1 is a perspective view of a connector constructed in accordance with the present invention shown installed on a barrier wall, and also showing a mateable connector.

FIG. 1 illustrates a connector installation 10 which includes an electrical connector 12 installed in a connector-receiving hole 14 of a barrier wall 16. The barrier wall has rear and front faces 20, 22, and there may be a pressure difference across the wall. In one example, the barrier wall 16 is a wall of a vehicle transmission, with pressured oil lying on the rearward face of the wall, with the pressure of oil varying between 0 when the engine is not running to about 6 psi (above the ambient pressure existing on the forward face of the wall) during typical running conditions, up to about 10 psi under unusual running conditions. The connector 12, which fits into a hole of one inch diameter, is designed to enable easy installation and yet to reliably withstand the variable pressure differences while passing electrical signals between wire 24 on a mateable connector 26 (which does not include features of the present invention), through mating terminals 30, to wires 32 extending rearwardly from the connector 12.

Figure 2:
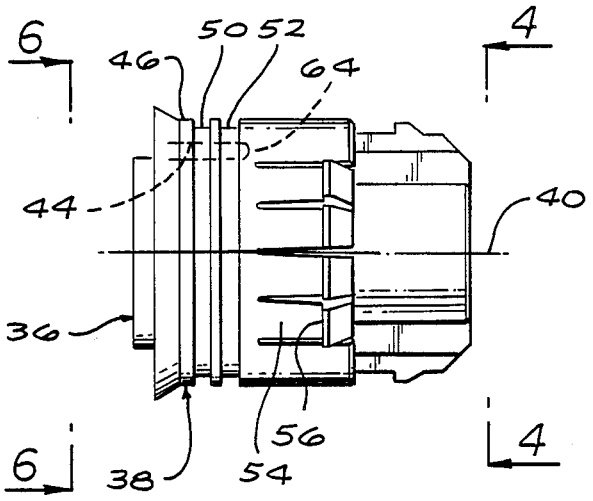
FIG. 2 is a side elevation view of the connector of FIG. 1.

As shown in FIG. 3, the connector includes a frame 34 with a radially inner frame portion 36 and with a skirt 38 extending around the inner frame portion. The connector and frame have an axis 40 that extends parallel and approximately coincident with the axis 42 of the barrier wall hole when the connector is installed in the barrier wall. The skirt 38 has radially inner and outer sides 44, 46, with the radially outer side having grooves 50, 52 (FIG. 2) that are designed to receive elastomeric seals of the O-ring type. The connector also includes several resilient locking fingers 54 that each form a ledge 56 that can snap behind a front surface portion 60 (FIG. 3) of the connector-engaging surface 62 that includes the surface of the barrier wall hole 14. The connector is installed by aligning the front ends of the fingers 54 with the rear of the hole 14, and pushing the connector forwardly until the fingers snap into place. This can be accomplished rapidly and without tools or separate fasteners.

The frame includes a connecting portion 64 extending between the frame inner portion 36 and both the skirt 38 and the locking fingers 54. The fingers extend forwardly, in the direction of arrow F, from the connecting portion 64, while the skirt 38 extends rearwardly, in the direction R, from the connecting portion. The connecting portion 64 extends continuously 360° about the frame axis 40 between the inner frame portion and the skirt so the connector is fluid-tight. Similarly, the region at the center of the connector at and within the inner frame portion 36 is fluid-tight. A pair of O-ring seals 66, 68 are mounted on the skirt rearward of the connecting portion 64, with the more forward seal 68 spaced a distance S rearward of the connecting portion and the other seal 66 spaced even further rearward.

The connector frame is formed of a molded thermoplastic material, which is much more elastic than the barrier wall which is generally formed of metal such as steel. Fluid pressure applied to the inner side 44 of the skirt causes it to expand radially by a small amount, while removal of pressure causes it to contract to its original configuration. The size of the connector and the hole in the barrier wall are designed so that when the connector is initially installed, the pair of O-ring seals 66, 68 are slightly compressed to form a fluid-tight seal between the surface 62 of the hole and the seals. When a higher pressure exists at the rear face 20 of the barrier wall than at the front face 22, as when an oil pump 70 of an engine is operating to maintain oil pressure on the rear side of the wall, the pressure causes radially outward expansion of the skirt 38, which causes the seals 66, 68 to press with greater force against the hole surface. This is advantageous in that having the seals press harder results in greater resistance to leakage of oil, which is necessary when the pressure on the rear side of the barrier wall is higher.

When the engine and oil pump stop so the pressure differential across the barrier wall decreases to 0, the skirt 38 can contract, which results in reduced compression of the seals 66, 68. In many applications, the engines and oil pump 70 are turned on and off a few times each day, and are left off most of the time. As a result, the seals 66, 68 are left only lightly compressed most of the time, which avoids "set" of the seals. Setting, or permanent deformation of the seals previously commonly occurred where the seals were subjected to considerable compression that was maintained for long periods of time. Avoiding such set results in more reliable sealing both when there is a high pressure differential and when there is a zero pressure differential.

Figure 6:
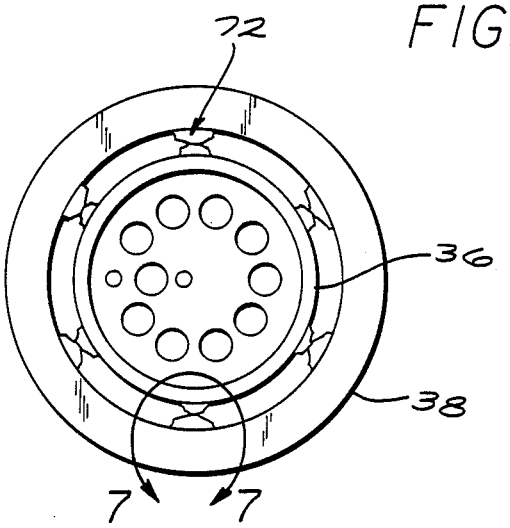
FIG. 6 is a view taken on the line 6—6 of FIG. 2.
Figure 7:
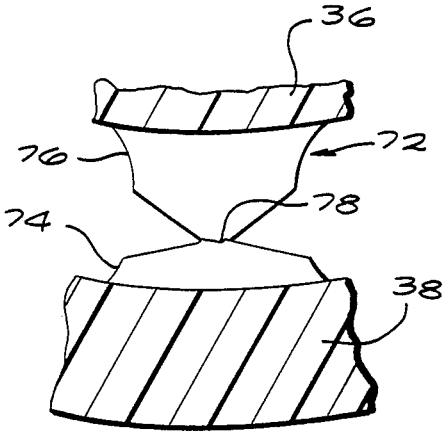
FIG. 7 is a sectional view of the region 7—7 of FIG. 6.

The connector frame is formed with several skirt-deflection limiters 72 located rearward of the connecting portion 64 of the frame. Each limiter extends between the skirt 38 and the inner frame portion 36. As shown in FIGS. 6 and 7, each limiter has separable portions 74, 76 located respectively on the skirt and on the frame inner portion. These portions 74, 76 can separate at a dividing line 78, when a high pressure exists at the rear face of the barrier wall. However, when the high pressure is relieved, and the skirt contracts radially, the separable portions 74, 76 of the limiter abut and limit radially inward movement of the skirt. Thus, even if heat, outward skirt deflection, and other factors tend to cause permanent warping or other deformation of the skirt, the limiters maintain the skirt at a position to keep the O-ring seals under at least some compression to assure a fluid-tight seal.

Figure 8:
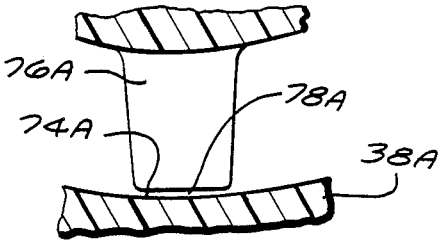
FIG. 8 is a partial sectional view of a limiter of another embodiment of the invention.

Applicant can construct the limiters as shown in FIG. 7, with a necked region at the dividing line 78, and with the limiter portion 74, 76 integral until a large pressure is applied that breaks the limiter at the line 78. However, it is also possible to form the limiter as shown in FIG. 8, so a portion 74A forming part of the skirt 38A is initially molded to be separate from an inner portion 76A, so the dividing line at 78A is present in the connector frame as molded, although this can be difficult to mold.

When the connector is initially installed in the barrier hole and the front ends 62 (FIG. 3) of the locking fingers snap into place, the rear 80 of the skirt forms a restriction to the forward passage of fluid to the seals 66, 68. The rear of the skirt forms a bevelled sealing surface 82 on its radially outer side, that matches an abutting rear surface portion 84 of the connector-receiving surface 62 of the hole in the barrier wall. Since the existence of high pressure at the rearward surface of the barrier wall causes radially outward deflection of the skirt 38, it also tends to press the sealing surfaces 82 at the rear of the skirt against the surface portion 84. While the mating of the surfaces 82, 84 cannot be relied upon to avoid leakage of oil, the close engagement of these surfaces minimizes the forward flow of oil or other fluid to the seals, which results in only a gradual increase in pressure across the seals even when the pressure on the rear face of the barrier wall increases rapidly, as when oil at a level below the bottom of the connector is splashed onto the connector.

As mentioned above, the connector can be rapidly installed without tools in the barrier wall. The connector is oriented so when the fingers snap in place, the sides 90 (FIGS. 4 and 5) of the some of the fingers substantially abut shoulders 92 formed in the barrier wall at ends of the finger-engaging front surface portions 60. It may be noted that the front of the connector has projections 94 that facilitate mating with another connector, but these projections are known in the prior art.

Thus, the invention provides a connector for installation in a hole in a barrier wall across which a pressure difference can exist, which effectively seals against the passage of fluid. The connector has a frame with an inner portion and with a skirt surrounding the inner portion and holding at least one elastomeric seal pressed against the surface of the hole. The seal lies rearward of a connecting portion where the skirt and inner frame portion are connected, so that increased fluid pressure against the skirt causes it to expand and press the seal with greater force against the hole surface. The force on the seal is relieved when the pressure decreases. The frame can include limiters that allow radially outward expansion of the skirt when high pressure is applied, but which limit radially inward deflection of the skirt to assure that the seals press against the hole surface even when pressure is relieved. The rear of the skirt can form a sealing surface that can press facewise against a corresponding mating surface formed at the rear of the barrier wall to minimize the flow of fluid to the seal.

Although particular embodiments of the invention have been described and illustrated herein, it is recognized that modifications and variations may readily occur to those skilled in the art and consequently it is intended to cover such modifications and equivalents.

What is claimed is:

1. A connector for installation in a hole in a barrier wall wherein the barrier wall forms a connector-engaging wall surface at said hole and wherein a pressure differential can exist at opposite sides of the barrier wall with the pressure higher at a rear side of the wall than at a front side of the wall, comprising:

a connector frame with front and rear ends which can mount in said hole in said barrier wall, said frame having a frame axis and said frame including a radially inner portion and a skirt extending around said inner portion, said skirt having radially inner and outer sides;

an elastomeric seal mounted on said outer side of said skirt to bear against said wall surface at said hole;

said frame having a connecting portion extending between said frame inner portion and said skirt at a location on said skirt spaced forward of said elastomeric seal, with said inner side of said skirt open to said higher pressure at said rear side of said barrier wall, whereby pressure at said inner side of said skirt tends to deflect the skirt to press the seal against the wall surface.

2. The connector described in claim 1 wherein:

said frame includes a plurality of skirt deflection limiters located rearward of said connecting portion with each limiter extending between said skirt and said frame inner portion;

each of said limiters having separable portions respectively on said skirt and frame inner portion, said separable portions allowing corresponding locations on said skirt and frame inner portion to separate when high pressure deflects the skirt radially outwardly, but said separable portions limiting radially inward movement of said skirt so said seals continue to be compressed against said wall surface.

3. The connector described in claim 1 including said barrier wall and wherein said barrier wall surface includes an abutting rear surface portion at the rear of said hole and wherein:

said skirt includes a rear forming a sealing surface on its radially outer side, that matches said rear surface portion of said barrier wall to bear substantially facewise thereagainst, whereby to minimize the rate of fluid flow past said skirt sealing surface to said elastomeric seal.

4. The connector described in claim 1 including said barrier wall, and wherein said barrier wall surface forms a finger-engaging front surface facing in a primarily forward direction and said barrier wall also forms a beveled abutting rear surface at the rear of said hole; and wherein said connector includes a plurality of resilient locking fingers having free forward ends with ledges that abut said finger-engaging front surface of said barrier wall to prevent rearward movement of the frame;

said skirt includes a beveled rear sealing surface on its radially outer side that substantially bears facewise against said barrier wall abutting rear surface.

5. A connector for installation in a hole in a barrier wall, comprising:

a connector frame having front and rear ends and an axis, said frame includes an inner frame portion, a skirt with front and rear ends extending about said inner frame portion, and a connecting portion connecting said front end of said skirt to said inner frame portion;

an elastomeric seal extending about said skirt at a location rearward of said connecting frame portion, whereby fluid pressure applied to the rear of said connector frame when it lies in said hole causes expansion of said skirt and radially outward pressing of said seal against the surface of said hole in said barrier wall.

6. The connector described in claim 5 wherein:

said frame includes a plurality of skirt-deflection limiter means extending largely radially between said inner frame portion and locations on said skirt that lie rearward of said connecting portion, said limiter means limiting the radially-inward deflection of said skirt locations toward said inner frame portion while allowing radially outward deflection of said skirt locations away from said inner frame portion.

7. The connector described in claim 5 wherein:

said frame includes a plurality of limiters, each extending largely radially between said inner frame portion and a location on said skirt that lies rearward of said connecting portion, each limiter having radially inner and outer limiter portions that can separate radially to allow the skirt location to move radially outward and that abut to limit radially inward movement of the skirt.

8. The connector described in claim 7 wherein:

each of said limiters includes a breakable member which is breakable at a location between said inner and outer limiter portions when said skirt is forced away from said inner frame portion.

9. The connector described in claim 5 including:

a barrier wall having front and rear faces and a hole with a hole surface, said connector frame extending through said hole, with said seal pressing against said hole surface;

means for applying a higher fluid pressure to said rear face of said wall than to said front face.

10. A connector installation comprising:

a barrier wall having front and rear faces and having a connector-receiving hole having a hole axis, said barrier wall forming a finger-engaging front surface facing in a substantially forward direction, said barrier wall also forming an abutting rear surface at the rear of said hole;

a connector having a frame with an inner frame portion, a plurality of resilient locking fingers having rear ends connected to said inner frame portion and free front ends, said front ends being radially deflectable and having ledges that abut said finger-engaging front surface of said barrier wall when said connector lies in said barrier wall hole, said connector frame also having a skirt with a front end connected to said inner frame portion and a substantially free rear end having a beveled sealing surface that substantially abuts said abutting rear surface at the rear of said hole.

* * * * *